US012419424B2

(12) United States Patent
Yang

(10) Patent No.: US 12,419,424 B2
(45) Date of Patent: Sep. 23, 2025

(54) CHAIR AND ONE-PIECE CHAIR BACK THEREOF

(71) Applicant: Teng-Jen Yang, Taichung (TW)

(72) Inventor: Teng-Jen Yang, Taichung (TW)

( * ) Notice: Subject to any disclaimer, the term of this patent is extended or adjusted under 35 U.S.C. 154(b) by 221 days.

(21) Appl. No.: 18/452,234

(22) Filed: Aug. 18, 2023

(65) Prior Publication Data

US 2023/0397731 A1 Dec. 14, 2023

Related U.S. Application Data

(63) Continuation-in-part of application No. 17/653,971, filed on Mar. 8, 2022, now abandoned.

(51) Int. Cl.

| | |
|---|---|
| ***A47C 5/12*** | (2006.01) |
| ***A47C 7/16*** | (2006.01) |
| ***A47C 7/40*** | (2006.01) |
| ***A47C 7/42*** | (2006.01) |

(52) U.S. Cl.

CPC ..... *A47C 7/40* (2013.01); *A47C 5/12* (2013.01); *A47C 7/42* (2013.01); *A47C 7/16* (2013.01)

(58) Field of Classification Search

CPC ..... A47C 5/12; A47C 7/16; A47C 7/42
USPC ..... 297/446.1, 447.3, 447.4, 448.2
See application file for complete search history.

(56) References Cited

U.S. PATENT DOCUMENTS 3,275,371 A * 9/1966 Rowland ..... A47C 1/124 297/446.1 X
3,724,897 A * 4/1973 Faiks ..... A47C 1/124 297/447.3 X
3,999,802 A * 12/1976 Powers ..... A47C 3/04 297/447.3 X
D259,598 S * 6/1981 Locher ..... D6/380
6,109,696 A * 8/2000 Newhouse ..... A47C 7/42 297/448.2 X
6,250,718 B1 * 6/2001 Newhouse ..... A47C 5/06 297/448.2 X
D449,938 S * 11/2001 Vanderiet ..... D6/369
D455,571 S * 4/2002 Van De Riet ..... D6/374
6,957,860 B1 * 10/2005 Leist ..... A47C 3/04 297/448.2 X
7,073,864 B2 * 7/2006 Olsen ..... A47C 3/023 297/447.3 X
7,429,084 B2 * 9/2008 Diedrich ..... A47C 4/02 297/440.16
7,441,758 B2 * 10/2008 Coffield ..... B29D 7/01 297/452.15 X (Continued)

FOREIGN PATENT DOCUMENTS

WO WO-2010045745 A1 * 4/2010 ..... A47C 1/03255

*Primary Examiner* — Rodney B White

(74) *Attorney, Agent, or Firm* — Wang Law Firm, Inc.

(57) ABSTRACT

A chair with a chair back having a frame and a backrest. The backrest is connected to a bottom frame portion of the frame and two side frame portions at two opposite ends of the bottom frame portion by injection molding for a user to lean against. A hardness of the backrest is lower than a hardness of the frame, and the frame is provided with two supporting portions for correspondingly supporting two sides of the user's waist. Thereby, the components with different hardness are capable of forming the integrally formed chair back, and enabling the chair back to be both supportive and comfortable for leaning against.

11 Claims, 4 Drawing Sheets

(56) References Cited

U.S. PATENT DOCUMENTS 7,681,956 B2 * 3/2010 Huang ..... A47C 3/00 297/448.2 X
7,775,600 B2 * 8/2010 Battey ..... A47C 7/32 297/440.15
7,971,935 B2 * 7/2011 Saez ..... A47C 5/04 297/446.1 X
8,096,620 B2 * 1/2012 Wilson ..... B60N 2/682 297/446.1 X
8,511,752 B2 * 8/2013 Grove ..... A47C 7/42 297/440.16
8,511,753 B2 * 8/2013 Huang ..... A47C 4/02 297/446.1 X
8,991,932 B2 * 3/2015 Okuda ..... A47C 7/44 297/452.31
9,332,851 B2 * 5/2016 Machael ..... A47C 7/445
9,706,847 B2 * 7/2017 Piretti ..... A47C 5/04
9,826,838 B2 * 11/2017 Piretti ..... A47C 7/002
10,588,414 B2 * 3/2020 Olarte ..... A47C 5/06
11,197,552 B2 * 12/2021 Piretti ..... A47C 7/445
2006/0103222 A1 * 5/2006 Caruso ..... A47C 7/16 297/452.1
2013/0147252 A1 * 6/2013 Schmitz ..... A47C 7/40 297/452.21
2014/0077573 A1 * 3/2014 Schneider ..... A47C 7/16 297/452.14
2014/0097660 A1 * 4/2014 Summerville ..... A47C 31/007 297/452.11 X
2015/0250319 A1 * 9/2015 Burwell ..... A47C 1/03255 428/105
2016/0157615 A1 * 6/2016 Piretti ..... A47C 7/44 297/301.1
2017/0164745 A1 * 6/2017 Huang ..... A47C 4/03
2018/0027973 A1 * 2/2018 Ludwig ..... A47C 1/03277
2018/0084914 A1 * 3/2018 Deevers ..... A47C 7/282
2018/0352961 A1 * 12/2018 Deevers ..... A47C 1/03255
2019/0133327 A1 * 5/2019 Ludwig ..... A47C 3/18
2023/0284780 A1 * 9/2023 Yang ..... A47C 5/12
2023/0292925 A1 * 9/2023 Koch ..... A47C 7/40 297/452.18
2023/0389708 A1 * 12/2023 Tanaka ..... A47C 3/12
2025/0024949 A1 * 1/2025 Cerantola ..... A47C 7/16

* cited by examiner

CHAIR AND ONE-PIECE CHAIR BACK THEREOF

CROSS REFERENCE TO RELATED APPLICATION

This application is a continuation in part of U.S. patent application Ser. No. 17/653,971, which claims the earlier filing date of Mar. 8, 2022, the entire specification of which is incorporated herein by reference.

BACKGROUND

Field of Invention

The invention relates to a chair back structure, and more particularly to a chair and a one-piece chair back thereof.

Description of Related Art

Existing one-piece chair backs are mostly made of a single material through injection molding. However, in order to maintain good support for such chair backs, the selected material is usually relatively hard and less elastic and tough, resulting in the sacrifice of the user's comfort to some extent when leaning against the chair back.

Therefore, how to manufacture an integrally formed chair back with materials of different hardness is an issue to be overcome at present.

SUMMARY

Therefore, one object of the invention is to provide a chair and a one-piece chair back thereof capable of enabling the chair back to have components with at least two different hardness through design of a manufacturing process and selection and allocation of material ratios.

Another object of the invention is to provide a chair and a one-piece chair back thereof, the chair back is capable of supporting a softer (with a lower hardness or tougher) backrest for a user to lean against by a harder (with a higher hardness) frame.

Yet another object of the invention is to provide a chair and a one-piece chair back thereof, the chair back is capable of forming two supporting portions corresponding to waist positions of a user through a harder (with a higher hardness) frame in order to improve supporting strength and comfort of the chair back.

According to one embodiment of the invention, a one-piece chair back provided is applicable for supporting an upper body of a user, the upper body has a waist, the one-piece chair back comprises: a frame comprising a bottom frame portion, two side frame portions connected at two opposite ends of the bottom frame portion, and an accommodating space jointly formed by the bottom frame portion and the side frame portions; and a backrest disposed in the accommodating space and connected to the bottom frame portion and the side frame portions by injection molding, the backrest is provided for the upper body of the user to lean against, and a hardness of the backrest is lower than a hardness of the frame.

Wherein a first inner side of each of the side frame portions of the frame facing the backrest is provided with a supporting portion, extension directions of the supporting portions are opposite, the backrest is provided with a notch respectively on two opposite second inner sides facing the side frame portions, the notches correspond to the supporting portions, and positions of the supporting portions and the notches correspond to positions on two sides of a waist of the user.

In some embodiments, the frame and supporting legs are made of same materials but in different proportions.

In some embodiments, materials of the frame include nylon and glass fiber, and a content of the glass fiber is 7-30% by weight.

In some embodiments, materials of the supporting legs include nylon and glass fiber, and a content of the glass fiber is 7-50% by weight.

In some embodiments, the backrest is made of nylon or polyether based thermoplastic polyurethane (TPU).

In some embodiments, the supporting portion is provided with at least one first vent hole, and the backrest is provided with at least one second vent hole.

In some embodiments, the backrest is sequentially divided into a first supporting area, a second supporting area corresponding to the waist of the user, and a third supporting area from top to bottom, the first supporting area, the second supporting area and the third supporting area are respectively with the second vent hole, and the second vent hole of the second supporting area is smaller than the second vent holes of the first supporting area and the third supporting area.

In some embodiments, a distance is provided between the two supporting portions of the frame.

In some embodiments, a fixing slot is provided in an end surface of one end of each of the supporting legs away from the frame, and the fixing slot is provided for inserting a chair seat.

In addition, the invention further provides a chair according to one embodiment, the chair comprises the chair back and a chair seat connected to the supporting legs of the chair back.

BRIEF DESCRIPTION OF THE DRAWINGS

Other aspects and advantages of the invention will be discovered after studying the detailed description in conjunction with the following drawings.

DETAILED DESCRIPTION

Figure 1:
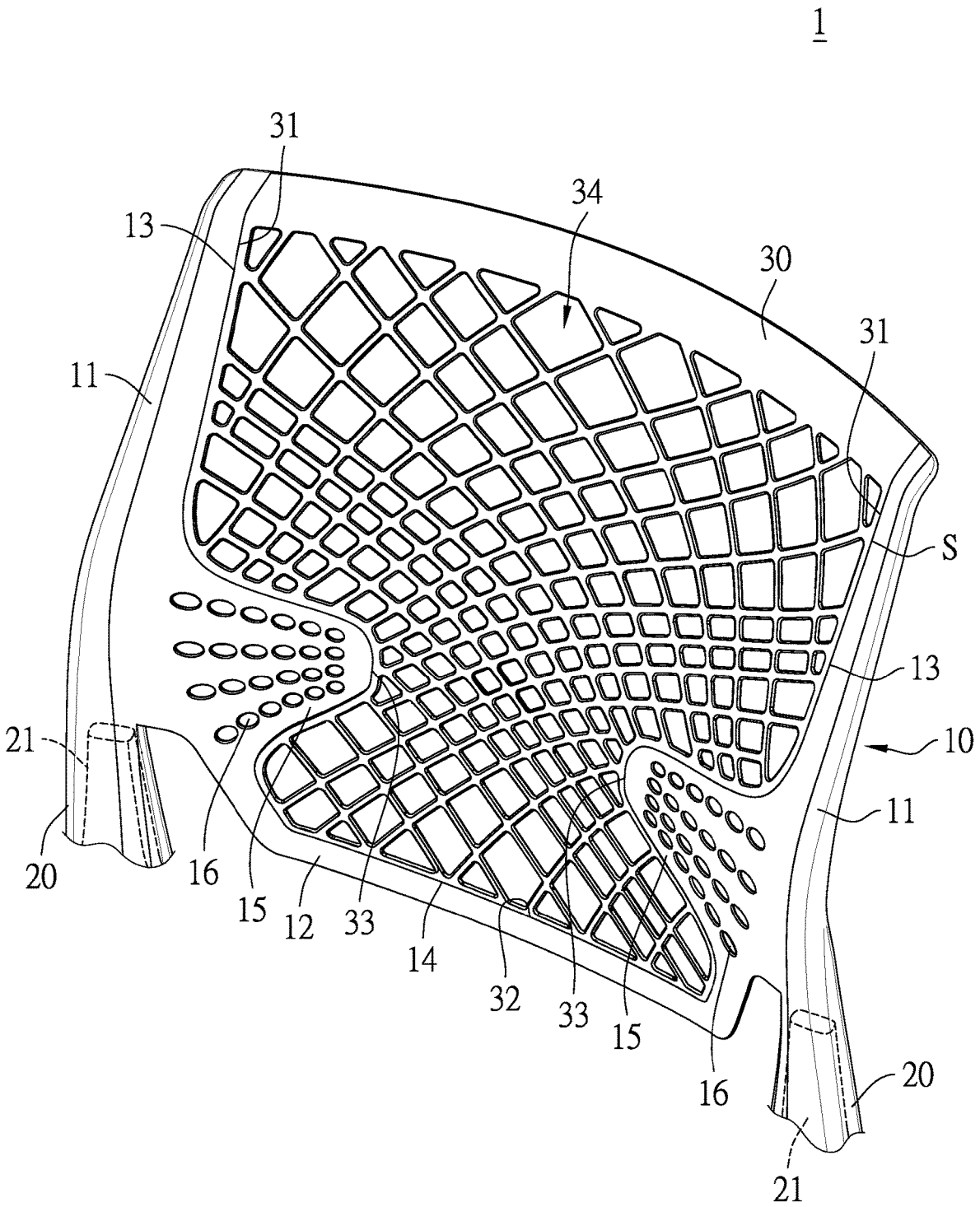
FIG. 1 is a perspective view of a chair back according to one embodiment of the invention.
Figure 2:
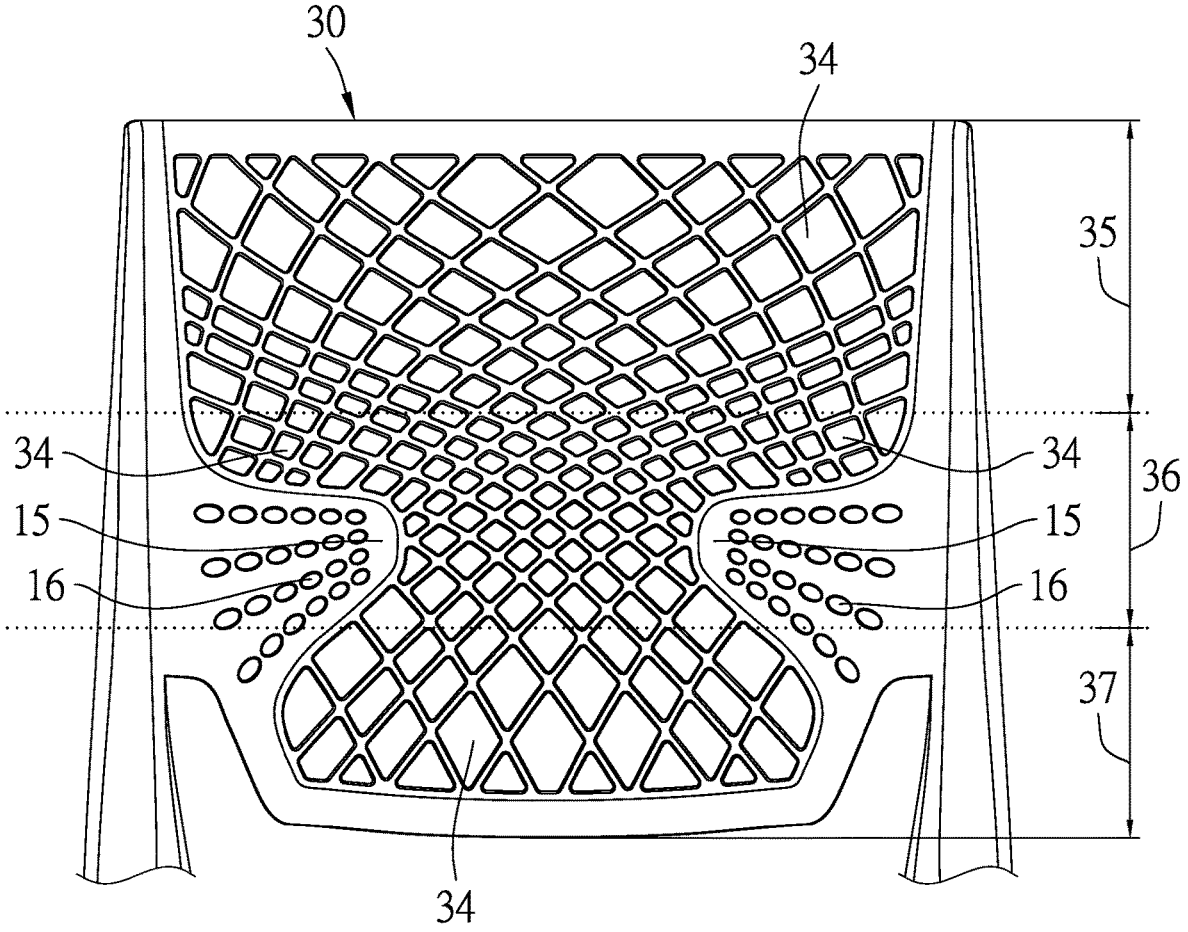
FIG. 2 is a front view of the chair back according to one embodiment of the invention.
Figure 3:
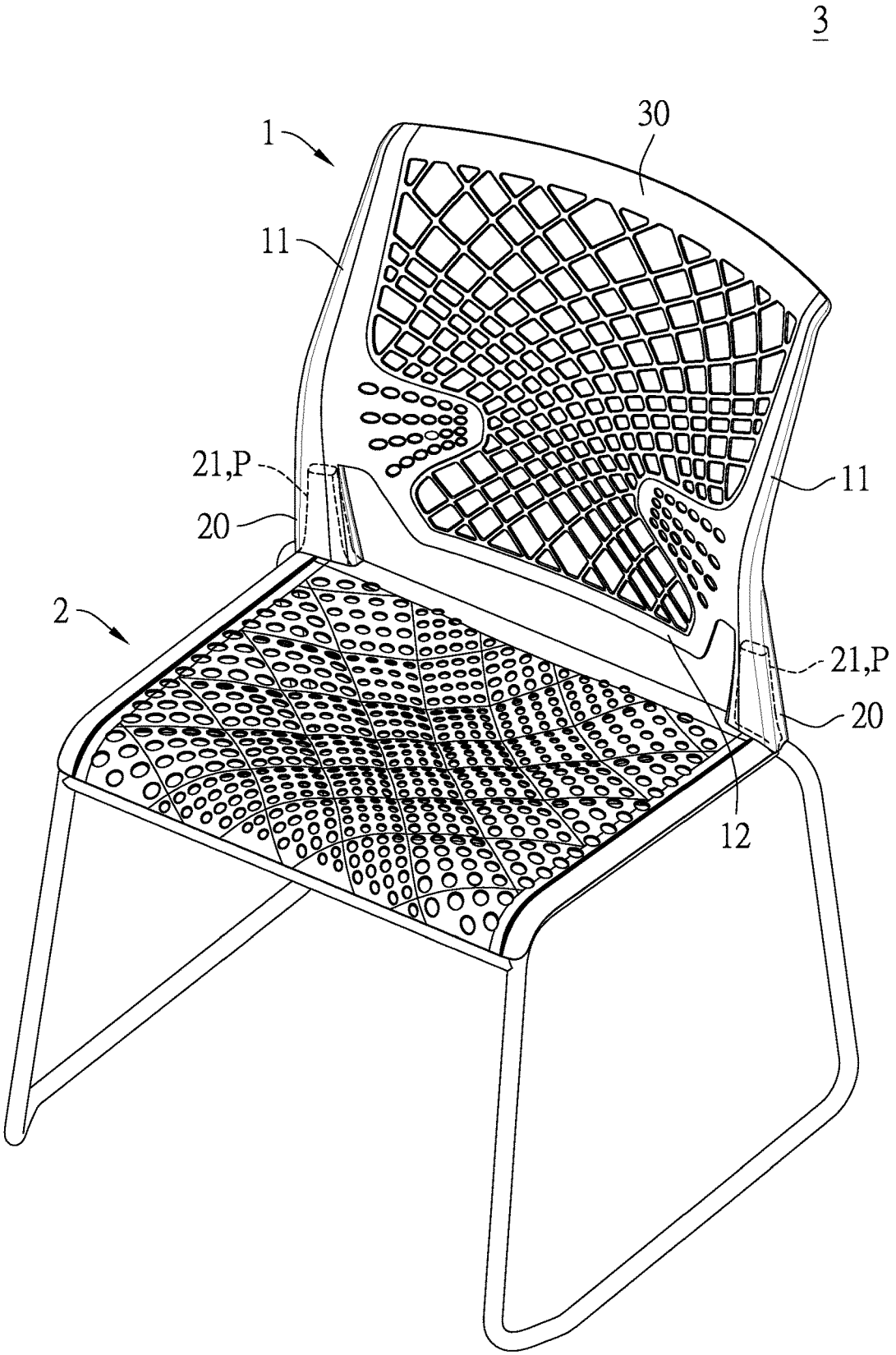
FIG. 3 is a perspective view of a chair according to one embodiment of the invention.

In the following detailed description, numerous specific details are set forth in order to provide a thorough understanding of the invention. However, it will be understood by a person having ordinary skill in the art that the invention can be implemented without these specific details. In other instances, well-known methods, procedures and/or elements have not been described in detail so as not to obscure the invention.

Please refer to FIG. 1 to FIG. 4. According to one embodiment of the invention, a chair back 1 provided is applicable for being assembled to a chair seat 2 to form a chair 3. What needs to be explained first is that, in order to make the figure clear and easy to understand, FIG. 4 omits drawing of vent holes of the chair back 1. The chair 3 is provided for a user 90 to sit on, and the chair back 1 provided for an upper body 91 of the user 90 to lean against. The upper body 91 has a waist 911. The chair back 1 comprises a frame 10, two supporting legs 20 and a backrest 30.

The frame 10 is integrally formed and can comprise two side frame portions 11 and a bottom frame portion 12. The two side frame portions 11 are respectively located on two opposite sides of the chair back 1 and two opposite ends of the bottom frame portion 12. Two opposite ends of the bottom frame portion 12 are respectively connected to the two side frame portions 11. The two side frame portions 11 and the bottom frame portion 12 jointly form an accommodating space S. Materials of the frame 10 can be, for example but are not limited to, nylon (such as but is not limited to PA66) and glass fiber, and a content of the glass fiber of the frame 10 is 7 to 30% by weight, such as but is not limited to 10, 16, 20, 24 or 28% by weight.

The two supporting legs 20 are connected to the frame 10 through injection molding. Specifically, the two supporting legs 20 are respectively located on two opposite sides of the chair back 1, and each of the supporting legs 20 is formed at a junction of the side frame portion 11 on a same side and the bottom frame portion 12. Each of the supporting legs 20 is recessed with a fixing slot 21 in an end surface of one end away from the frame 10, and the fixing slot 21 is provided for inserting a plug-in P of the chair seat 2. A hardness of the supporting legs 20 is higher than a hardness of the frame 10. Materials of the supporting legs 20 include nylon (such as but is not limited to PA66) and glass fiber, and a content of the glass fiber of the supporting legs 20 is 7-50% by weight, such as but is not limited to 20, 30, 35, 40 or 45% by weight. Therefore, the supporting legs 20 are configured to support the entire chair back 1 and are detachably assembled to the chair seat 2. 70% by weight nylon with 30% by weight glass fiber can make the supporting legs 20 have better chemical properties, dimensional stability, heat resistance, aging resistance, and even its fatigue strength can also be increased by as much as 2.5 times compared to the supporting legs 20 without glass fiber. The higher a glass fiber content of the supporting legs 20, the higher a hardness of the supporting legs 20.

The backrest 30 is connected to the two side frame portions 11 and the bottom frame portion 12 of the frame 10 by injection molding, and is located in the accommodating space S, and is integrally formed. Specifically, the backrest 30 has two opposite second inner sides 31 and a second inner bottom side 32 connecting with the two second inner sides 31. The two second inner sides 31 of the backrest 30 are respectively connected with two first inner sides 13 of the side frame portions 11 of the frame 10. The second inner bottom side 32 of the backrest 30 is connected with a first inner bottom side 14 of the bottom frame portion 12 of the frame 10. The first inner bottom side 14 of the bottom frame portion 12 is connected with the two first inner sides 13 of the side frame portions 11. Therefore, the backrest 30 can be supported by the frame 10 and can be provided for the upper body 91 of the user 90 to lean against. Compared with material properties of the frame 10, the backrest 30 can be made of materials with lower hardness but higher tensile strength and elasticity, such as but are not limited to nylon (such as but is not limited to PA66), thermoplastic polyurethane or a combination thereof. Therefore, when the upper body 91 of the user 90 leans against the backrest 30, the backrest 30 will be slightly deformed due to an exerted force, thereby slightly wrapping around a back of the user 90, which can not only support the back of the user 90, but can also provide proper cushioning effect. Thereby, the backrest 30 is conformed to ergonomic design, and comfort of sitting for the user 90 can be increased.

In addition, in this embodiment or some embodiments, a supporting portion 15 can extend from the first inner side 13 of each of the side frame portions 11. The supporting portions 15 extend in opposite directions. Each of the two second inner sides 31 of the backrest 30 is provided with a notch 33. The two notches 33 respectively correspond to the two supporting portions 15. Since a hardness of the two supporting portions 15 is higher than a hardness of the surrounding backrest 30, and positions of the two supporting portions 15 correspond to positions on the left and right sides of the waist 911 of the user 90, an effect of supporting a lower back of the user 90 can be enhanced, while improving a supporting strength and a comfort of the chair back 1.

Figure 4:
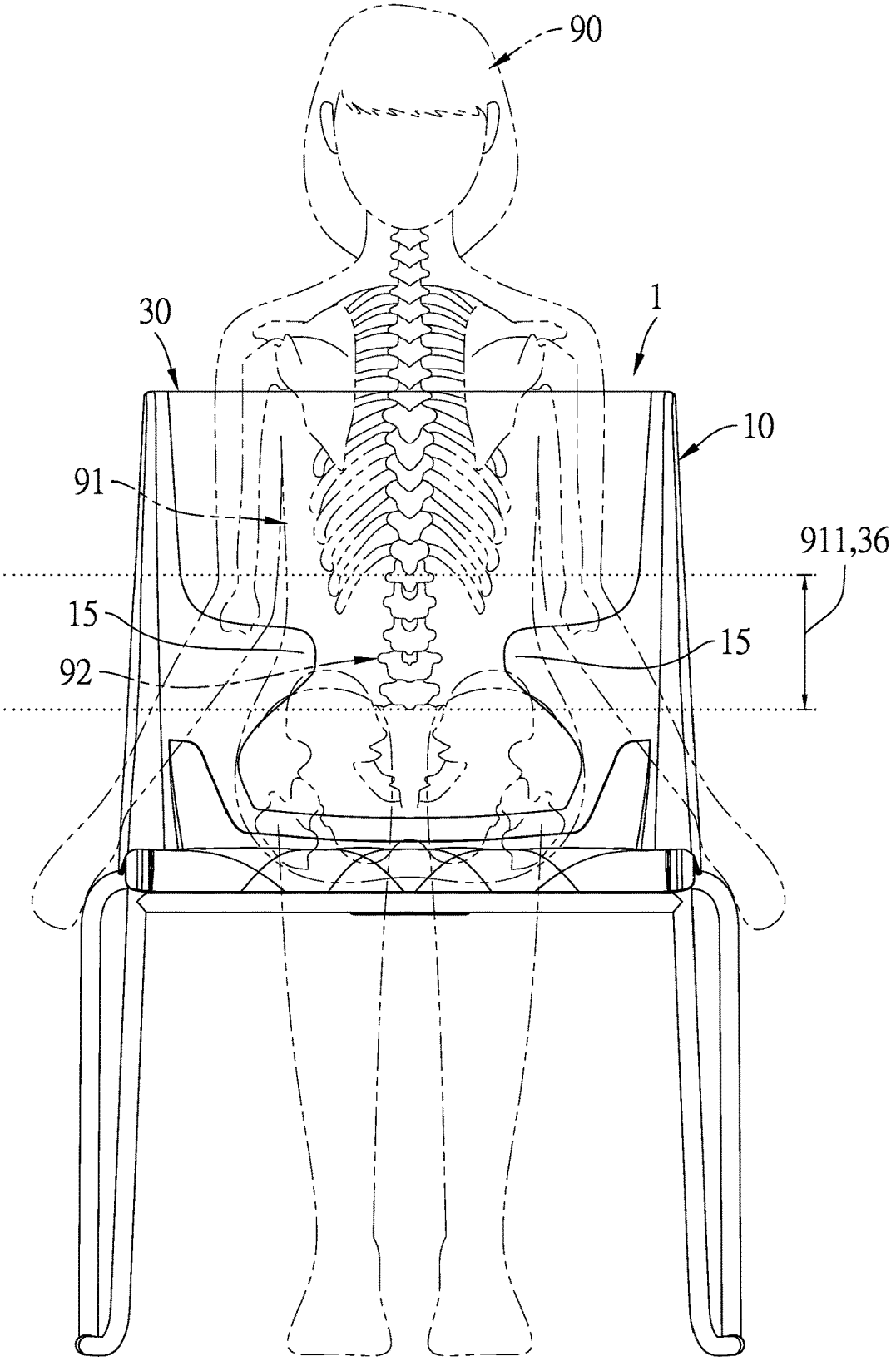
FIG. 4 is a diagram of usage state according to one embodiment of the invention.

It is worth mentioning that, referring to FIG. 4, the invention particularly designs a distance between the two supporting portions 15 of the frame 10, so that when the upper body 91 of the user 90 leans against the chair back 1, in addition to the two supporting portions 15 capable of effectively supporting both sides of the waist 911 of the user 90, a gap is provided between the two supporting portions 15 for a lumbar spine 92 of the user 90 to pass through, that is, the two supporting portions 15 of the frame 10 with a higher hardness will not support the lumbar spine 92 of the user 90, and the lumbar spine 92 of the user 90 is only supported on the backrest 30 with a low hardness, so that the chair back 1 has better support and comfort at the same time.

In this embodiment or some embodiments, at least one of the side frame portions 11 can be provided with at least one first vent hole 16. For example, each of the supporting portions 15 of the side frame portions 11 has the first vent holes 16. Thereby, air permeability of the chair back 1 at a lower back of the user 90 can be improved.

In this embodiment or some embodiments, the backrest 30 can be provided with a grid structure, and the grid structure has a plurality of second vent holes 34. Through this grid structure, the backrest 30 can be more elastic and cushioning. The second vent holes 34 of the grid structure are distributed at positions on an upper back and a lower back of the chair back 1, so air permeability of the chair back 1 at the upper back and the lower back can be improved. However, the invention is not limited thereto. In another embodiment, the backrest 30 can also be changed to have the second vent hole 34. Please refer to FIGS. 2 and 4, in this embodiment, the backrest 30 is sequentially divided into a first supporting area 35, a second supporting area 36 corresponding to the waist 911 of the user 90, and a third supporting area 37 from top to bottom. The first supporting area 35, the second supporting area 36 and the third supporting area 37 are provided with the second vent holes 34. The second vent holes 34 of the second supporting area 36 are smaller than the second vent holes 34 of the first supporting area 35 and the third supporting area 37. Thereby, with a design of the second vent holes 34 of the second supporting area 36 being smaller than the second vent holes 34 of the first supporting area 35 and the third supporting area 37, a structural strength of the second supporting area 36 of the backrest 30 is higher than a structural strength of the first supporting area 35 and the third supporting area 37 of the backrest 30. Since the second supporting area 36 corresponds to a middle of the waist 911 of the user 90, in addition to the backrest 30 having excellent air permeability through a design of the second vent holes 34, a supporting effect on the waist 911 of the user 90 can be enhanced by a design of the second supporting area 36.

Although each of the two supporting legs 20 in the above embodiments has the fixing slot 21 for inserting the plug-in P of the chair seat 2, the invention is not limited to this connection mode. In other embodiments, each of the two supporting legs 20 can also be modified to be provided with a plug-in to be inserted into two fixing slots of the chair seat 2.

Although the invention is disclosed above with the aforementioned embodiments, the embodiments are not intended to limit the invention. Without departing from the spirit and scope of the invention, all changes, modifications and combinations of implementation modes belong to the scope of the claims of the invention. Please refer to the appended claims for the scope of protection defined by the invention.

What is claimed is:

1. A one-piece chair back applicable for supporting an upper body of a user, the one-piece chair back comprising:

a frame comprising a bottom frame portion, two side frame portions connected at two opposite ends of the bottom frame portion, and an accommodating space jointly formed by the bottom frame portion and the side frame portions; and a backrest disposed in the accommodating space and connected to the bottom frame portion and the side frame portions by injection molding, the backrest being provided for the upper body of the user to lean against, and a hardness of the backrest being lower than a hardness of the frame;

wherein a first inner side of each of the side frame portions of the frame facing the backrest is provided with a supporting portion, extension directions of the supporting portions are opposite, the backrest is provided with a notch respectively on two opposite second inner sides facing the side frame portions, the notches correspond to the supporting portions.

2. The one-piece chair back as claimed in claim 1, further comprising two supporting legs, each of the two supporting legs being connected to the frame through injection molding, and a hardness of the supporting legs being higher than a hardness of the frame.

3. The one-piece chair back as claimed in claim 2, wherein the supporting legs are made of nylon and glass fiber, and a content of the glass fiber is 7-50% by weight.

4. The one-piece chair back as claimed in claim 2, wherein a fixing slot is provided in an end surface of one end of each of the supporting legs away from the frame, and the fixing slot is provided for inserting a chair seat.

5. A chair, comprising the chair back as claimed in claim 2 and a chair seat connected to the supporting legs of the chair back.

6. The one-piece chair back as claimed in claim 2, wherein the frame and the supporting legs are made of the same materials but in different proportions.

7. The one-piece chair back as claimed in claim 1, wherein the frame is made of nylon and glass fiber, and a content of the glass fiber is 7-30% by weight.

8. The one-piece chair back as claimed in claim 1, wherein the backrest is made of nylon or polyether based thermoplastic polyurethane (TPU).

9. The one-piece chair back as claimed in claim 1, wherein the supporting portion is provided with at least one first vent hole, and the backrest is provided with at least one second vent hole.

10. The one-piece chair back as claimed in claim 9, wherein the backrest is sequentially divided into a first supporting area, a second supporting area, and a third supporting area from top to bottom, the first supporting area, the second supporting area and the third supporting area are each respectively provided with a second vent hole, and the second vent hole of the second supporting area is smaller than the second vent holes of the first supporting area and the third supporting area.

11. The one-piece chair back as claimed in claim 1, wherein a distance is provided between the two supporting portions of the frame.

* * * * *